US006875186B2

(12) United States Patent
Tucek et al.

(10) Patent No.: US 6,875,186 B2
(45) Date of Patent: Apr. 5, 2005

(54) PRESSURE-ACTUATED PERCUSSIVE DEVICE

(76) Inventors: Kevin B. Tucek, 3960 E. Palm La., #9, Mesa, AZ (US) 85215; Steven C. Shanks, 3960 E. Palm La., #9, Mesa, AZ (US) 85215

( * ) Notice: Subject to any disclaimer, the term of this patent is extended or adjusted under 35 U.S.C. 154(b) by 155 days.

(21) Appl. No.: 10/236,335

(22) Filed: Sep. 5, 2002

(65) Prior Publication Data

US 2004/0049137 A1 Mar. 11, 2004

(51) Int. Cl.[7] ..... A61H 23/04
(52) U.S. Cl. ..... 601/108; 601/107; 606/239
(58) Field of Search ..... 601/97, 107, 108, 601/110, 111, 112, 113, 114, 72, 73, 80, 6, 7; 606/237, 238, 239, 240, 241

(56) References Cited

U.S. PATENT DOCUMENTS 1,657,765 A * 1/1928 Pasque ..... 601/108
2,211,214 A * 8/1940 Miller ..... 601/6
3,955,563 A * 5/1976 Maione ..... 601/106
4,513,737 A 4/1985 Mabuchi
4,716,890 A 1/1988 Bichel
6,228,042 B1 * 5/2001 Dungan ..... 601/107
6,503,211 B2 * 1/2003 Frye ..... 601/107

* cited by examiner

*Primary Examiner*—Danton D. DeMille
*Assistant Examiner*—Quang D. Thanh
(74) *Attorney, Agent, or Firm*—Etherton Law Group, LLC; Sandra L. Etherton

(57) ABSTRACT

A hand-held percussive device for facilitating the redistribution of fat remaining after liposuction. A piston is driven pneumatically in a reciprocating motion externally against a patient's skin and is self-actuated. A floating valve works in cooperation with the piston such that when the device is pressed against a patient's skin, the reciprocating motion begins. When the device is retracted, the reciprocating motion stops.

3 Claims, 6 Drawing Sheets

PRESSURE-ACTUATED PERCUSSIVE DEVICE

FIELD OF INVENTION

This invention relates to generally to devices used to treat living bodies after surgery. This invention relates particularly to a noninvasive, pressure-actuated apparatus for applying percussions to a body to facilitate the redistribution of fat remaining after liposuction or to massage the body.

BACKGROUND

Liposuction involves inserting a cannula through small incisions in a body and vacuuming out fat cells. Typically the cannula is moved in a reciprocating motion in conjunction with a fan motion to remove the fat uniformly within a desired area. Ideally, deep pockets of fat, as opposed to the fat in the even superficial layer near the skin, is removed during liposuction. The fat remaining near the skin helps leave the skin with a smooth contour. However, sometimes the fat near the skin is absent naturally or removed during liposuction. To avoid contour irregularities such as dimpling or rippling, the fat that remains must be redistributed in a uniform manner, as well as replaced in some areas. To contour and give a better shape to a body, deep fat removed from one area may be deposited in another area.

Several methods have been developed to improve the texture of the skin and contour of the body after liposuction. Pressure dressings, girdles, or contouring garments are placed on a liposuction patient after surgery and may be worn for several days or weeks to help the skin adhere to the new shape and contract properly. It has been reported that liposuction patients have smoother skin if the skin is percussed, rolled or massaged by hand during or immediately after the surgery to redistribute the fat remaining after liposuction. These treatments have has other beneficial effects, as well, such as relaxing the patient. However, it is difficult for a practitioner to uniformly and continuously percuss or massage a patient at length, particularly in a relatively small area of the body, such as the area affected by liposuction. It is desirable to automate such a treatment.

Therefore, it is an object of this invention to provide an apparatus to massage a body be percussion. It is a further object of the invention to provide an apparatus that facilitates the redistribution of fat after liposuction.

SUMMARY OF THE INVENTION

The present invention is a hand-held percussive device for massaging a body and facilitating the redistribution of fat remaining after liposuction. A piston is driven by in a reciprocating motion externally against a patient's skin. The default position of the piston is in an "off" position, and the device is actuated when it is depressed against the skin of a patient. Preferably the piston is driven pneumatically and in the default "off" position the gas that drives the piston is exhausted through a port, away from the patient and practitioner. When the device is depressed against the skin of a patient, force is applied to the piston causing a floating valve that moves in concert with the piston to block the exhaust port. This redirects gas into the piston chamber and forces the piston out of the piston chamber. At its farthest extension, the floating valve unblocks the exhaust port, allowing the air to be redirected out, away from the piston allowing the piston to retract into the piston chamber. The cycle repeats itself as long as force is applied to the piston.

DETAILED DESCRIPTION OF THE INVENTION

Figure 1:
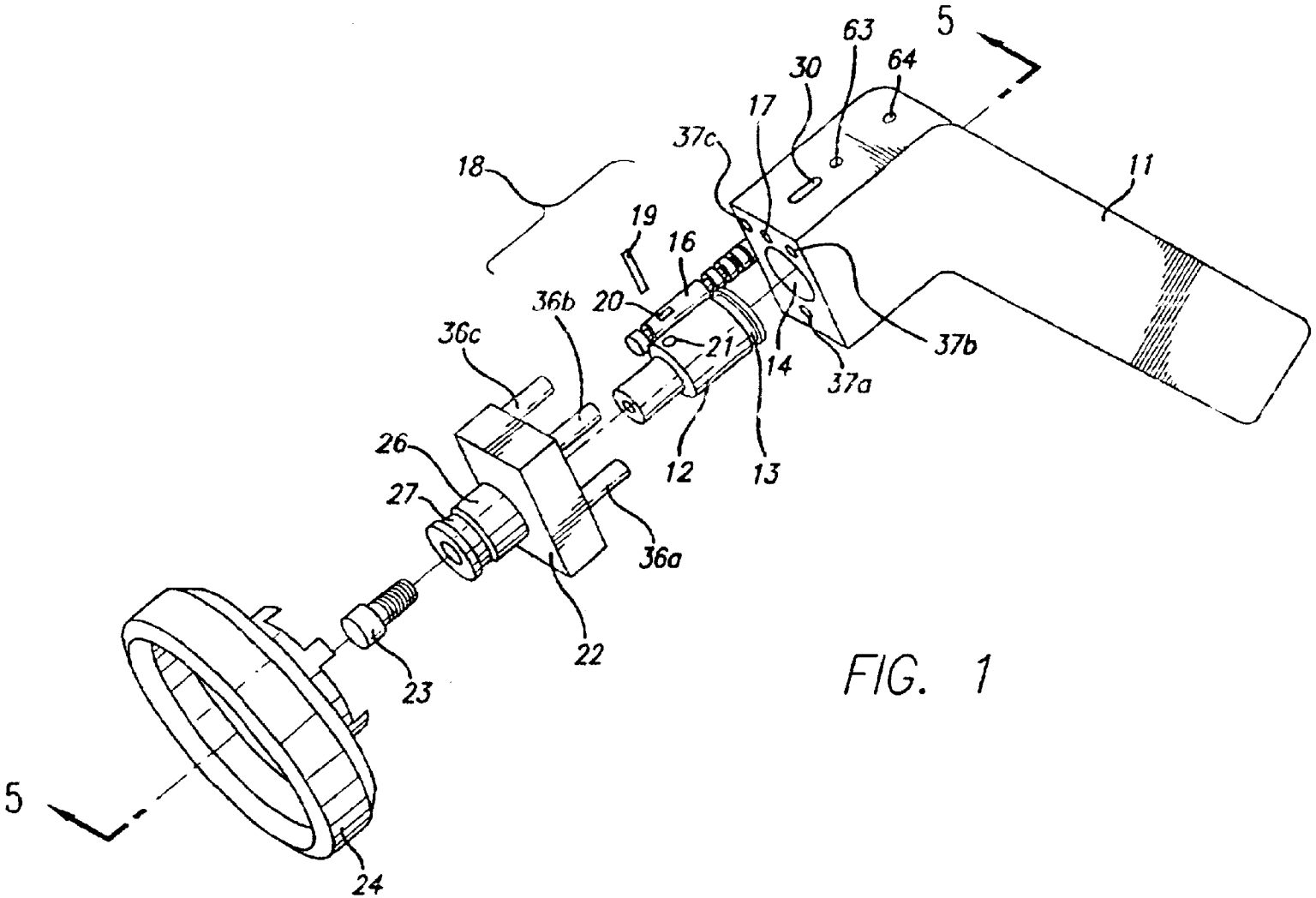
FIG. 1 is an exploded view of a first embodiment of the present invention.
Figure 2:
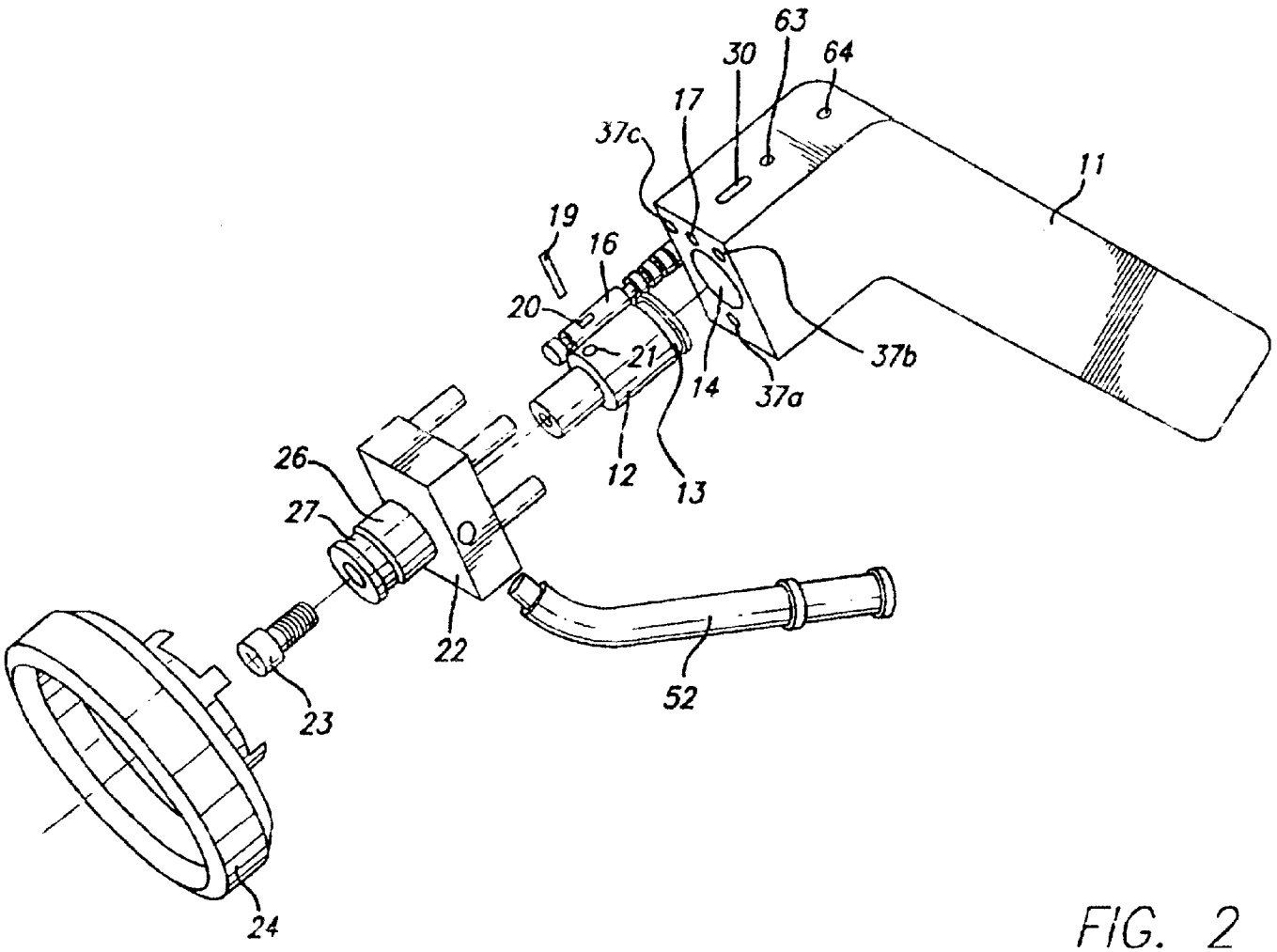
FIG. 2 is an exploded view of a second embodiment of the present invention.
Figure 3:
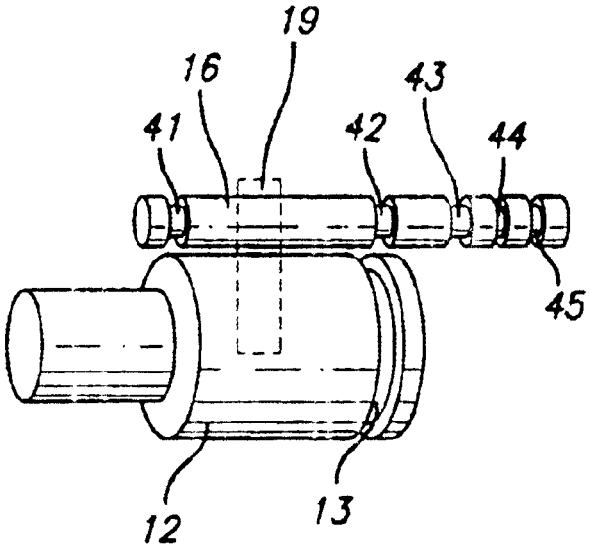
FIG. 3 is a side view of the valve assembly.
Figure 4:
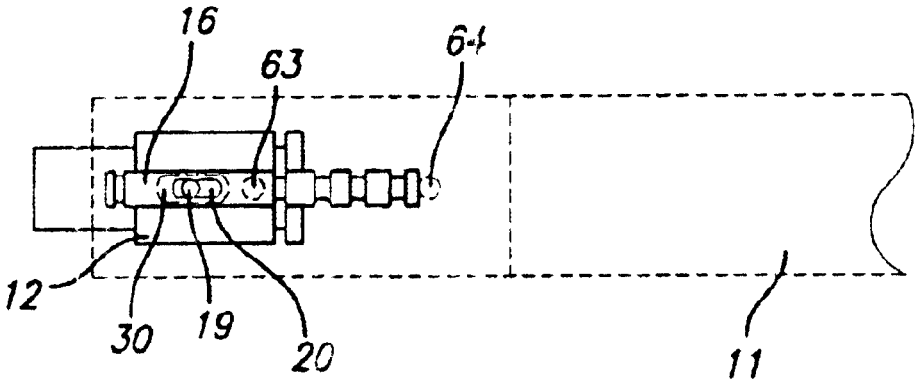
FIG. 4 is a top view of the valve assembly and housing.

Referring to FIGS. 1–8, there is illustrated a first embodiment of the present invention, designated generally as 10, wherein like numbers indicate like parts throughout. The device comprises a housing 11 which receives a piston 12 in an aperture referred to herein as a piston chamber 14. A substantially air-tight seal is formed between the piston 12 and piston chamber 14 by seating a piston o-ring 15 in the detent formed by an annular piston ring 13 having a smaller diameter than the piston 12. FIGS. 3 and 4 show the piston o-ring 15 disposed about the piston 12.

Figure 7:
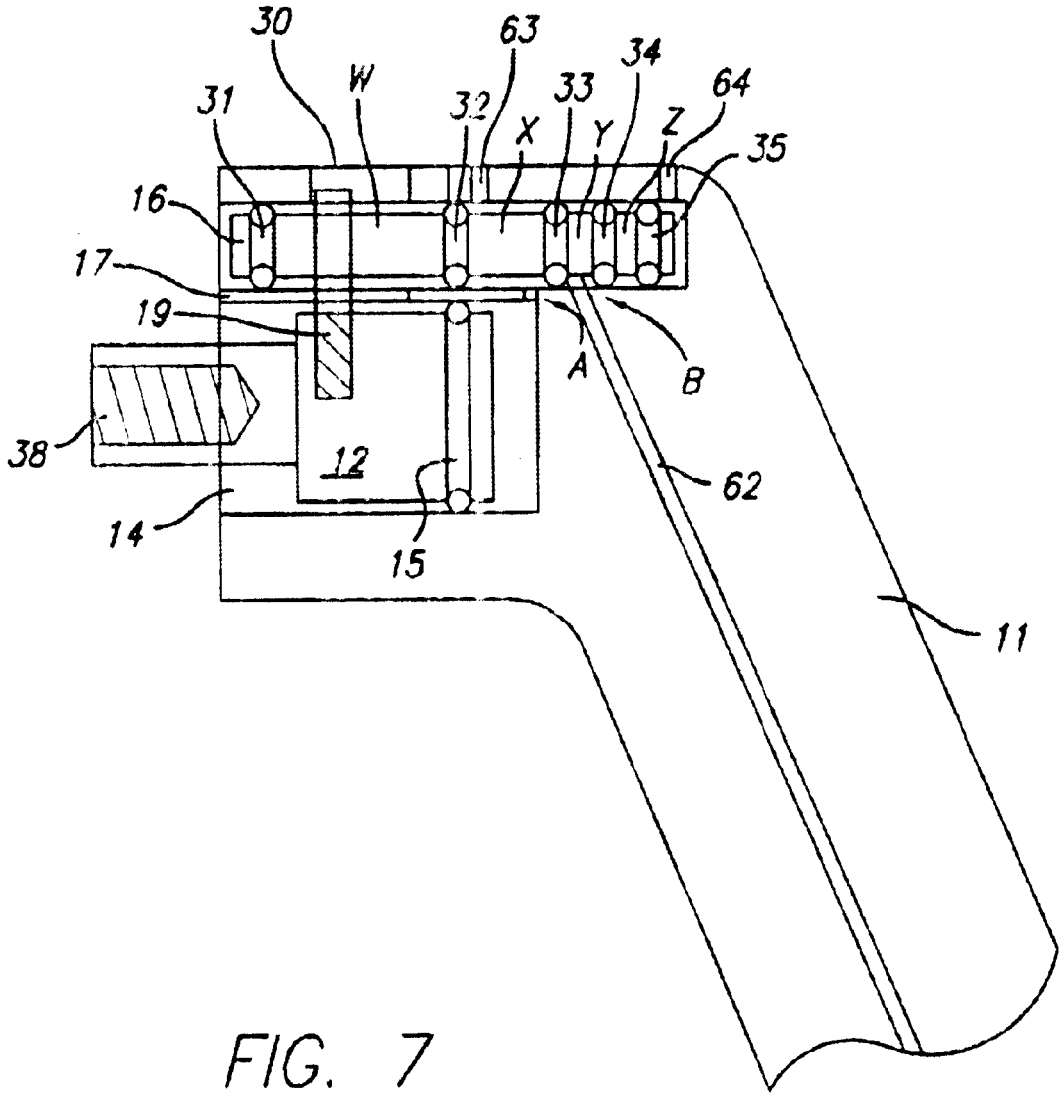
FIG. 7 is a detailed cross-section of the valve assembly, piston, and housing (head mount guide aperture omitted from view).

The housing 11 also has an aperture to receive a floating valve 16, the aperture referred to herein as a valve chamber 17. The valve chamber 17 and piston chamber 14 are in fluid communication at opening A, as indicated in FIG. 7. The floating valve 16 is part of a valve assembly 18, further comprising a pin 19 that fits loosely through an aperture in the housing 30, through an aperture 20 in the floating valve 16 and protrudes into an aperture 21 in the piston 12. This valve assembly 18 thereby causes the floating valve 16 and the piston 12 to move cooperatively and to be retained within the housing 11. Preferably the pin 19 and piston aperture 21 are matedly threaded.

Figure 5:
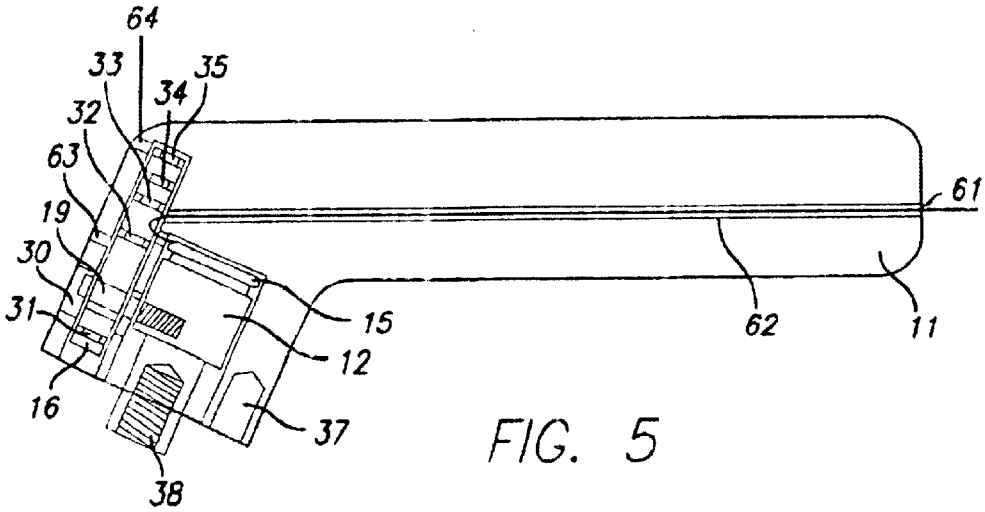
FIG. 5 is a cross-section view along line 5—5 of FIG. 1 showing the housing and valve assembly with gas flowing into the piston chamber thereby forcing the piston out.
Figure 6:
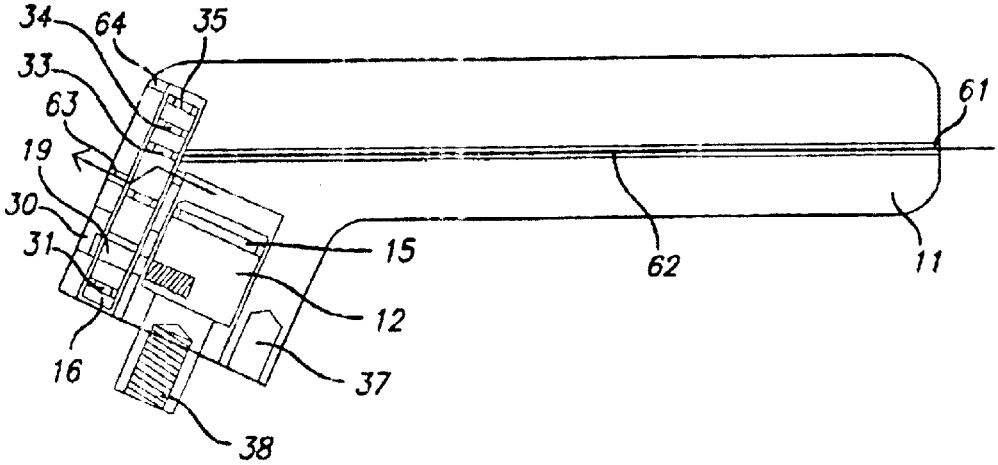
FIG. 6 is a cross-section view along line 5—5 of FIG. 1 showing the housing and valve assembly with gas flowing out the exhaust port, allowing the piston to retract into the piston chamber.

A series of substantially air-tight compartments are formed between the floating valve 16 and valve chamber 17 by seating several valve o-rings, 31, 32, 33, 34, and 35 in the detents formed by annular valve rings, 41, 42, 43, 44, 45, respectively, which have a smaller diameter than the floating valve 16. FIGS. 5 and 6 show the valve o-rings 31–35 disposed about the annular valve rings 41–45. FIG. 7 indicates the four compartments W, X, Y, and Z formed by the o-rings sealed against the valve chamber.

Referring now particularly to FIGS. 5, 6, and 7 the housing 11 has a inlet port 61 which is connected to a source of pressurized gas (not shown). The housing 11 has a primary exhaust port 63 and a secondary exhaust port 64. The inlet port 61 is in fluid communication with a gas channel 62 which is in fluid communication with the valve chamber 17 at B. As shown in FIG. 5, when the piston 12 is retracted into the piston chamber 14, the floating valve 16 is also in a retracted position. In the retracted position, the floating valve 16 blocks the gas flow to either exhaust port by positioning air-tight compartment X where the gas channel 62 opens into the valve chamber 17, namely B. This position causes a direct channel to form between the gas channel 62 and the piston chamber 14. Gas entering the inlet port 61 is thus directed into the piston chamber 14, thereby forcing the piston 12 out of the piston chamber 14. As soon as the pin 19 (which is stationery in the piston) comes in contact with the leading edge of the aperture 20 in the floating valve 16, the floating valve 15 will be pulled out of the valve chamber 17 in concert with the piston 12 until pin 19 comes in contact with the leading edge of the housing aperture 30. When the floating valve 16 is extended, compartment Y closes the gas channel 62 and simultaneously opens a channel between the piston chamber 14 and the primary exhaust port 63. Gas is exhausted from the piston chamber 14, allowing the piston 12 to retract into the piston chamber 14. As soon as the pin 19 comes in contact with the trailing edge of the aperture 20 in the floating valve 16, the floating valve will be retracted into the valve chamber 17 in concert with the piston 12. This, in turn, again blocks the gas flow to either exhaust port by positioning compartment X at B, thereby directing gas into the piston chamber 14 and forcing the piston 12 out of the piston chamber 14. The cycle will then repeat itself as long as a retracting force is applied to the piston 12, as explained in more detail below.

The speed at which the device operates is partially dependent on the pressure of the incoming gas. At sufficiently high speeds, the gas in the valve chamber 17 will not have time to flow to the primary exhaust port 63 before the floating valve 16 completely retracts. For this reason, a secondary exhaust port 64 is formed in the housing 11. The secondary exhaust port 64 allows gas in the valve chamber 17 to more quickly escape as the valve is displacing gas upon retraction.

While the preferred embodiment of the device is driven pneumatically, the reciprocating motion may also be driven electronically. In this embodiment, the piston 12 is in connection with an electrical source. A switch and means for biasing the piston in a reciprocal motion are in communication with the electrical source and the piston such that the electrical source and the switch cooperate to cause the piston to move in a reciprocating motion.

A head mount 22 is attached to the piston 12, preferably by a threaded screw 23 in piston/head mount aperture 38, although other means of attachment will suffice. A head 24 is attached to the head mount 22. The head 24 is preferably oval in cross-section, but may take on other shapes or have a larger or smaller diameter that the head 24 shown herein. Because they are attached to each other, the head 24 and head mount 22 move in concert with the piston 12. The head mount 22 has guides 36*a*, 36*b*, and 36*c* that slide in head mount guide apertures in the housing, 37*a*, 37*b*, and 37*c*, respectively.

The head 24 is also removable and may be interchanged with other heads. In the preferred embodiment, the head 24 is attached to the head mount 22 by a compression fit. As shown in FIGS. 1 and 2, the head mount 22 has an extension 26 having an annular ring 27. An o-ring 28 is seated in the annular ring of the extension 26. The head 24 has a center aperture 29 that is slightly larger in diameter than the extension 26, but smaller than the outside diameter of the extension o-ring. The head 24 is attached to the head mount 22 by forcing the center aperture 29 over the o-ring 28 fitted on the extension 26, causing the o-ring 28 to compress and the extension to protrude through the center aperture 29. In this manner the head 24 will stay attached to the head mount until it is pulled off with sufficient force to compress the o-ring 28.

The device is pressure-actuated when the piston 12 is depressed as a result of pressing the head 24 against the patient's skin. The default position of the piston is in an "off" position, wherein the gas that drives the piston is exhausted through a port, away from the patient and practitioner. This starts the cycle describes above, namely that when the head is depressed against the skin of a patient, the floating valve blocks the exhaust ports, thereby redirecting air into the piston chamber and forcing the piston out of the piston chamber. At its farthest extension, the floating valve unblocks the exhaust port, allowing the air to be redirected out, away from the piston allowing the piston to retract into the piston chamber. The cycle repeats itself as long as force is applied to the piston.

Figure 8:
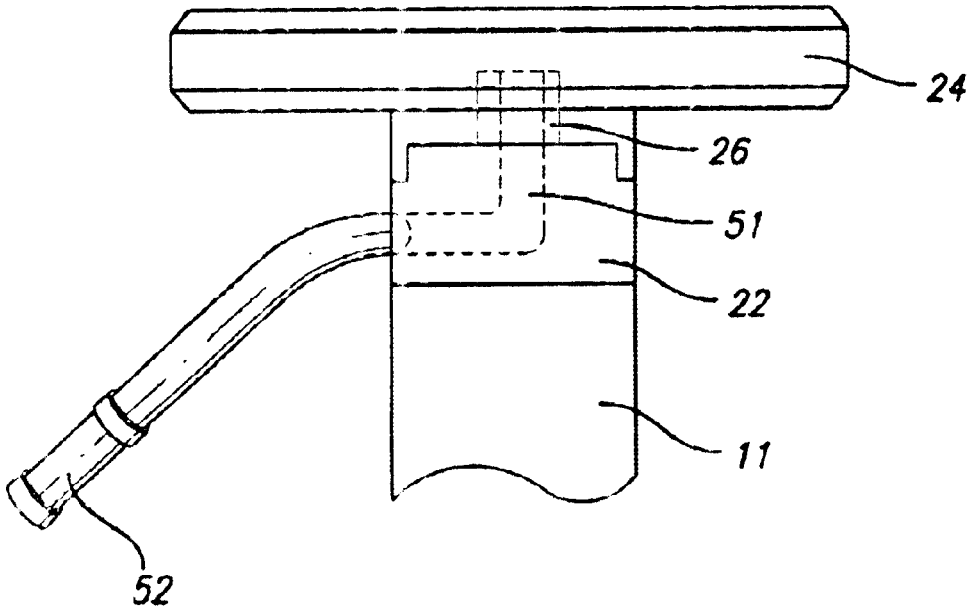
FIG. 8 is a top view of the second embodiment showing the head and the head mount in fluid communication with the vacuum source.

FIGS. 2 and 8 shows a second embodiment of the invention. The head mount 22 has a channel 51 therein that enables fluid communication between the head 24 and a source of vacuum 52. When the head 24 is pressed against the skin and the vacuum is turned on, the negative pressure gradient causes the skin to be sucked tightly against and slightly into the head 24.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A percussive device comprising:

a) a housing having a piston chamber and a valve chamber;

b) a piston that slides in a reciprocating motion in the piston chamber;

c) a floating valve that slides in a reciprocating motion in the valve chamber, the floating valve connected to the piston;

d) an inlet port in the housing;

e) an exhaust port in the housing;

f) a channel connecting the inlet port and the exhaust port; and g) a source of pressurized gas in connection with the inlet port;

such that when the piston is depressed, the floating valve and piston cooperate to cause the reciprocating motion and wherein:

h) the piston is a solid first cylinder having an annular piston ring of smaller diameter than the first cylinder;

i) a piston o-ring is seated in the annular piston ring such that a substantially air-tight seal is formed between the piston o-ring and the piston chamber;

j) the floating valve is a valve assembly comprising:

i. a solid second cylinder having a first, second, third, fourth and fifth annular valve ring, each valve ring having a smaller diameter than the second cylinder; and ii. a first, second, third, fourth, and fifth valve o-ring seated in each of the annular rings, such that a substantially air-tight seal is formed between the valve o-rings and the valve chamber respectively; and such that the valve o-rings create a first, second, third, and fourth compartments in the valve chamber;

such that when the piston is retracted, the fourth compartment blocks fluid communication between the inlet port and the exhaust port and when the piston is extended the second compartment is in fluid communication with the exhaust port.

2. The device according to claim 1 further comprising a pin connecting the first cylinder to the second cylinder.

3. The device according to claim 1 further comprising a second exhaust port in the housing.

* * * * *